US008065862B2

(12) United States Patent
Mansuino

(10) Patent No.: US 8,065,862 B2
(45) Date of Patent: Nov. 29, 2011

(54) METHOD AND DEVICE FOR PACKAGING A PRODUCT IN A WRAPPER OF SHEET MATERIAL

(75) Inventor: Sergio Mansuino, Mondovi (IT)

(73) Assignee: Soremartec S.A., Arlon (BE)

( * ) Notice: Subject to any disclaimer, the term of this patent is extended or adjusted under 35 U.S.C. 154(b) by 158 days.

(21) Appl. No.: 12/377,201

(22) PCT Filed: Aug. 6, 2007

(86) PCT No.: PCT/IB2007/053092

§ 371 (c)(1),
(2), (4) Date: Feb. 11, 2009

(87) PCT Pub. No.: WO2008/018008

PCT Pub. Date: Feb. 14, 2008

(65) Prior Publication Data

US 2010/0037560 A1 Feb. 18, 2010

(30) Foreign Application Priority Data

Aug. 11, 2006 (IT) ..... TO2006A0598

(51) Int. Cl.

| | |
|---|---|
| ***B65B 11/50*** | (2006.01) |
| ***B65B 61/24*** | (2006.01) |
| ***B65B 47/06*** | (2006.01) |
| ***B65B 49/08*** | (2006.01) |

(52) U.S. Cl. ..... 53/464; 53/221; 53/226

(58) Field of Classification Search ..... 53/461, 53/464, 203, 221, 226; 493/73, 79, 81, 446, 493/447, 449, 455, 474; *B65B 11/50, 47/06, 49/08, 61/24*

See application file for complete search history.

(56) References Cited

U.S. PATENT DOCUMENTS

| | | | | | |
|---|---|---|---|---|---|
| 1,392,683 | A | * | 10/1921 | Hackett et al. | 53/221 |
| 1,799,357 | A | * | 4/1931 | Davis | 493/79 |
| 2,297,432 | A | * | 9/1942 | Rasch et al. | 53/464 |
| 2,568,698 | A | * | 9/1951 | Amberg | 493/73 |
| 3,528,212 | A | * | 9/1970 | Jones | 53/464 |
| 4,330,289 | A | * | 5/1982 | Christensson | |
| 4,510,735 | A | * | 4/1985 | Cillario | 53/464 |
| 5,443,546 | A | * | 8/1995 | Bertalero | 53/464 |
| 5,802,806 | A | * | 9/1998 | Scaliti | 53/226 |
| 6,513,306 | B1 | * | 2/2003 | Milano | 53/461 |

FOREIGN PATENT DOCUMENTS

EP 1046579 A1 10/2000

* cited by examiner

*Primary Examiner* — Stephen F Gerrity

(74) *Attorney, Agent, or Firm* — Rothwell Figg Ernst & Manbeck P.C.

(57) ABSTRACT

A method and a device for packaging a confectionery product (P) in a shaped wrapper of sheet material (1, 2) having a cup-shaped portion (1*c*, 2*c*) (pleated cup) formed from the same sheet material as the product wrapper; the method and the device comprise the use or a mandrel with petals (14*a*, 14*b*) which cooperates with a forming cavity (11) and which may assume a retracted configuration so that it can penetrate into the forming cavity to shape the wrapper into a cup shape adhering to the product. The packaging is characterized in that the wrapper has a central region (2*a*) on which the product bears and from which the cup extends with a transverse dimension (or diameter) smaller than the maximum transverse dimension of the packaged product.

16 Claims, 6 Drawing Sheets

METHOD AND DEVICE FOR PACKAGING A PRODUCT IN A WRAPPER OF SHEET MATERIAL

CROSS REFERENCE TO RELATED APPLICATION(S)

This application is a 35 U.S.C. §371 National Phase Entry Application from PCT/IB2007/053092, filed Aug. 6, 2007, and designating the United States. This application also claims the benefit of Italian Patent Application No. TO2006A000598 filed Aug. 11, 2006, the disclosure of which is incorporated herein in its entirety by reference.

The present invention relates to a method and a device for packaging a product, in particular a confectionery product such as a praline or a chocolate, in a wrapper of sheet material.

The invention also relates to a packaging obtained by the method of the invention.

In the confectionery sector, it is conventional to package individual products, such as a praline, for instance, in a wrapper of sheet material which tightly encloses the product and then to insert the wrapped product in a cup of sheet material with a pleated peripheral wall (hereafter known by the appropriate term of "pleated cup") in order to present it in a more pleasing and attractive way. The term "pleated cup" as used in the present description does not however imply that the cup must have a pleated wall.

When the product is being packaged, this solution requires separate and distinct operations to obtain the pleated cup, wrap the product in its wrapper and insert the wrapped product in the pleated cup, possibly with an additional operation to attach the pleated cup to the base of the wrapped product by adhesion.

In order to reduce the number of packaging operations included in the conventional technique used in the confectionery sector and to obtain a packaging similar to the conventional packaging, EP-A-1 046 579 describes a method and a device for its provision in which the pleated cup is an integral part of the product packaging wrapper.

In particular, EP-A-1 046 579 describes a method comprising the operations of:

- obtaining an intermediate packaging, including a first sheet having a cup-shaped configuration, with a container wall including the product and a mouth surrounded by a radial flange formed by a peripheral region of this first sheet, and a second sheet having a central region disposed to cover the mouth and a peripheral region disposed in a superimposed relationship with respect to the peripheral region of the first sheet forming the flange; and
- shaping these peripheral regions of the intermediate packaging in order to form a wrapper portion shaped as a pleated cup which surrounds the container wall of the first shaped sheet at a radial distance, by means of shaping means which comprise a forming cavity able internally to receive the intermediate packaging and a male member, in the form of a punch, able to penetrate into the forming cavity in order to force the peripheral regions of the first and second sheets between the inner surface of the forming cavity and the outer surface of this male member.

Figure 8:
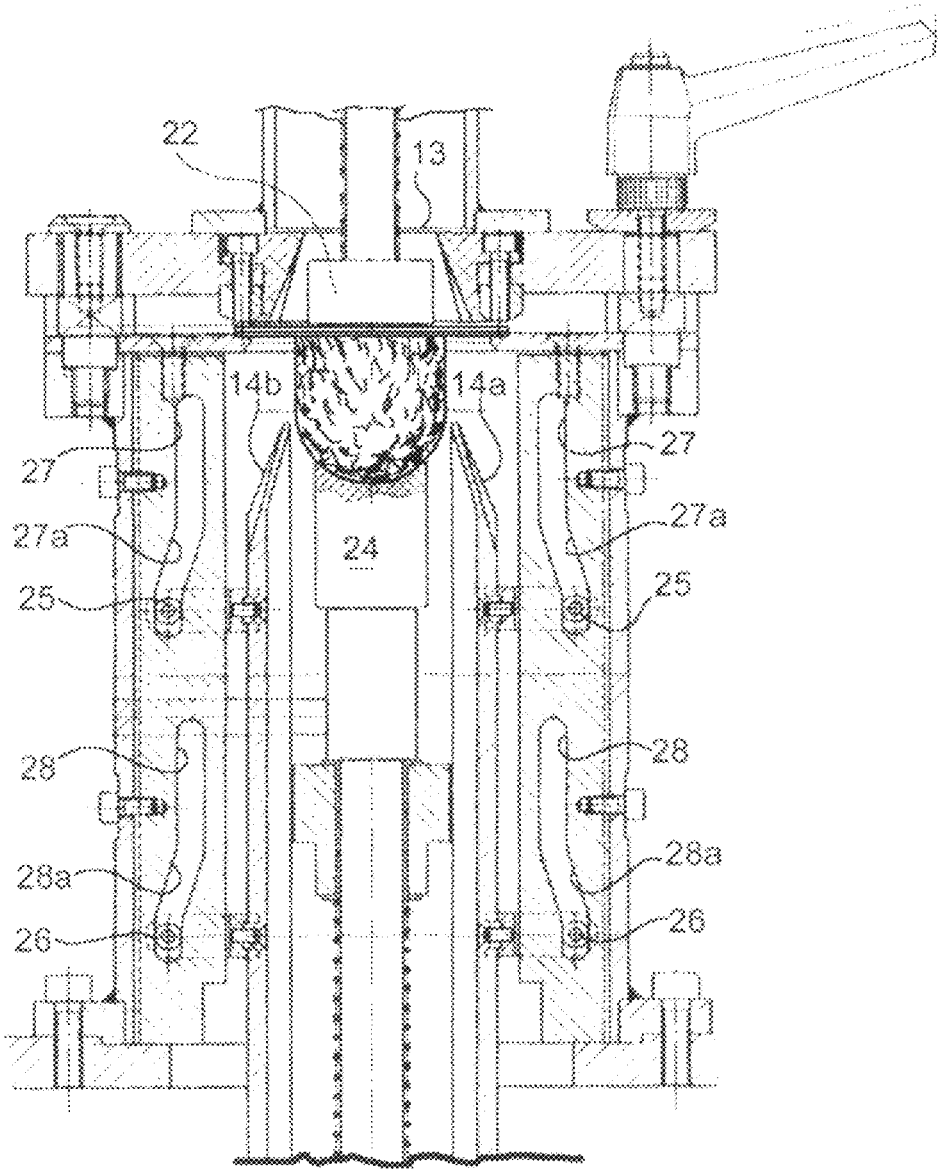

Prior to the final shaping operation of the peripheral regions of the first and second sheets, these peripheral regions are preferably sealed together, for instance by adhesion with the application of filler material, heat sealing or ultrasonic sealing so that the product is packaged in a hermetic wrapper having the configuration shown in FIG. 8 of EP-A-1 046 579.

By means of the method described above, in particular in cases in which the product has an ovoid or spherical shape, or a shape in which the dimension of its base is smaller than its maximum transverse dimension (or its maximum equatorial dimension in the case of products of spherical shape), it is difficult to ensure that the connected wrapper of sheet material, which forms the pleated cup, tightly wraps the product in its region facing the base of the pleated cup. This may raise a problem of air pockets in the hermetic wrapper and may in particular raise a problem of an aesthetic nature as the packaging is not able to reproduce the same aesthetic effect as produced by the insertion of a wrapped product in a separate pleated cup according to the conventional technique.

The present invention is intended to improve the method and the device described in the above-mentioned European Patent Application and pays particular attention to the problem of ensuring that the connected wrapper sheet material which forms the pleated cup tightly encloses the product. Moreover, the invention has been devised with a view to providing a packaging which—from an aesthetic point of view—has features entirely similar to conventional packagings of a hand-made nature.

In view of these objects, the invention relates to a method, a device and a packaging having the characteristic features set out in the appended claims.

Figure 5:
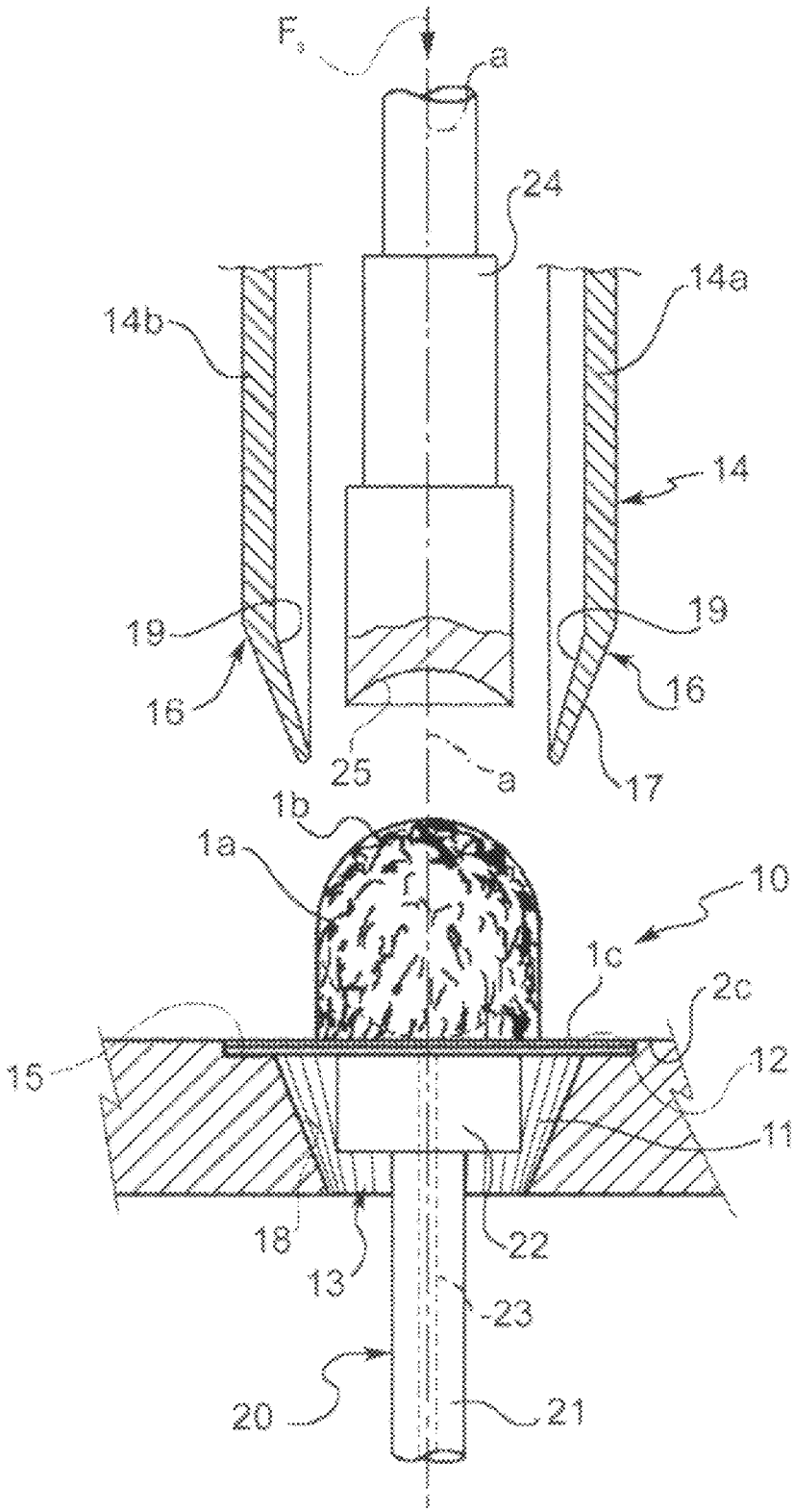
Figure 6:
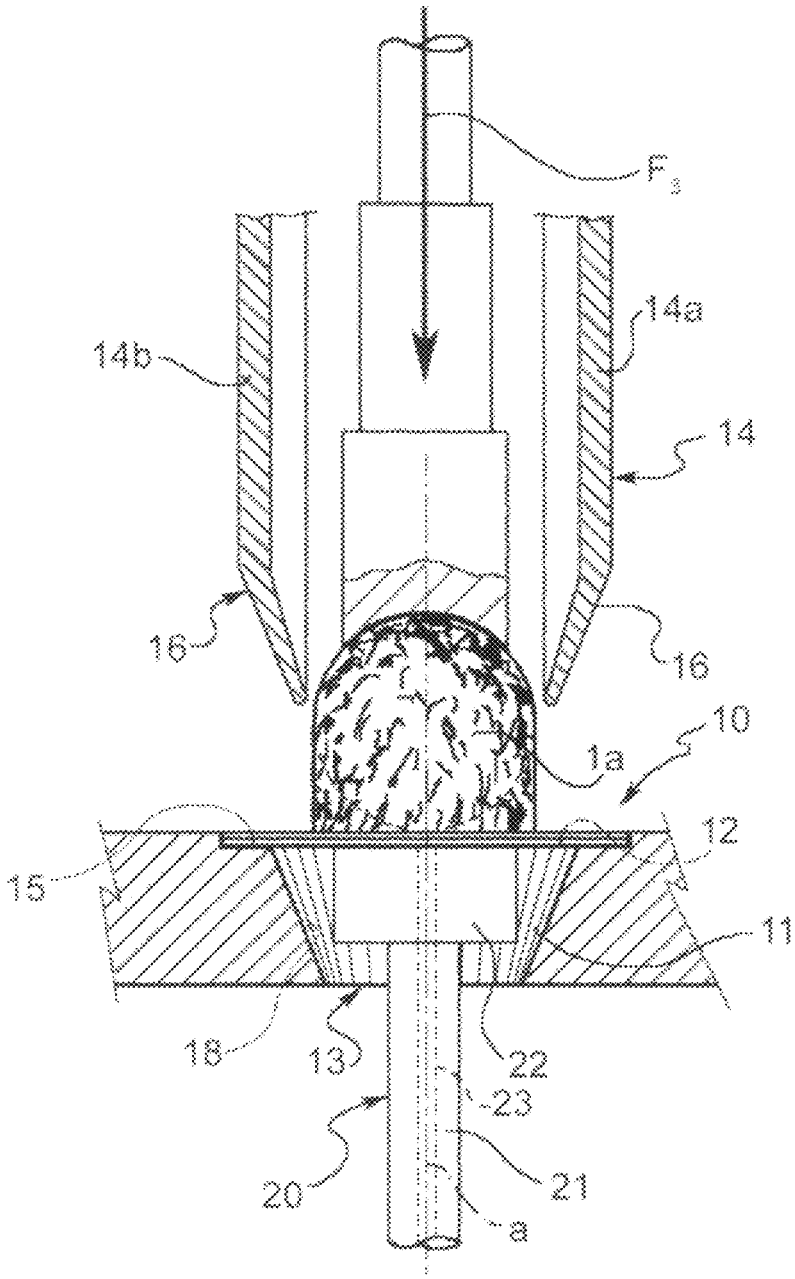
Figure 7:
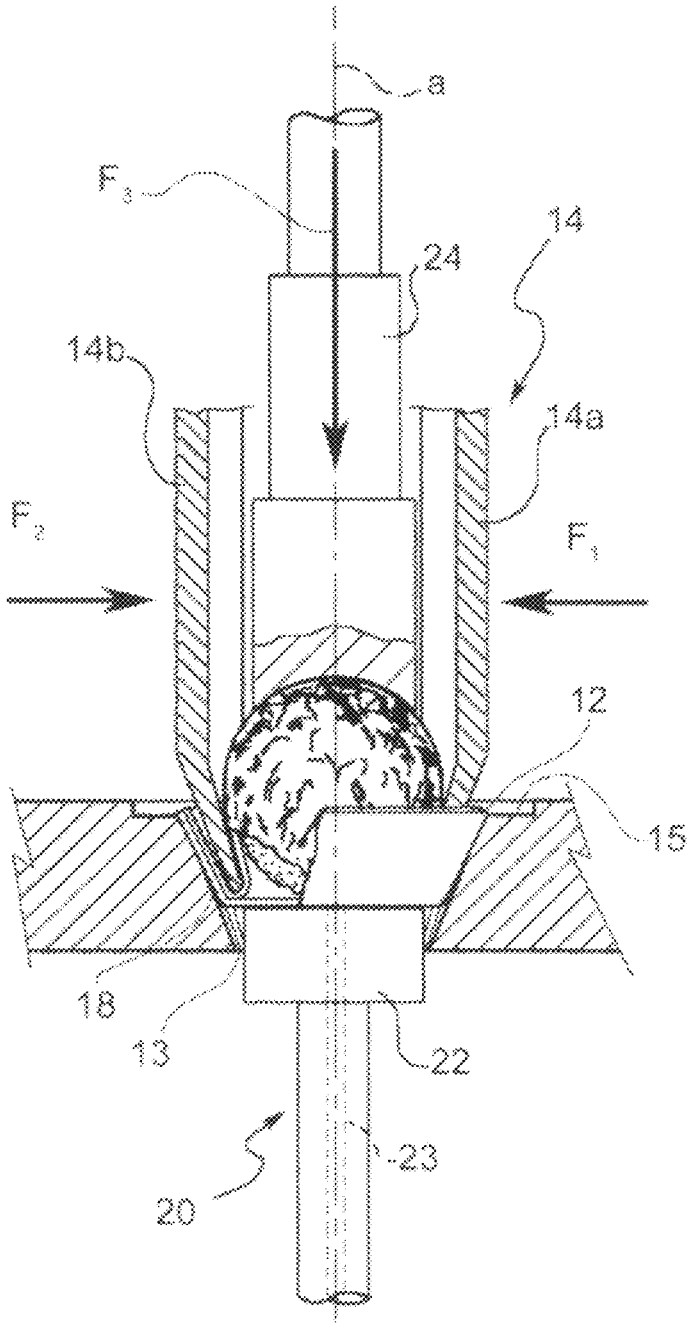
Figure 9:
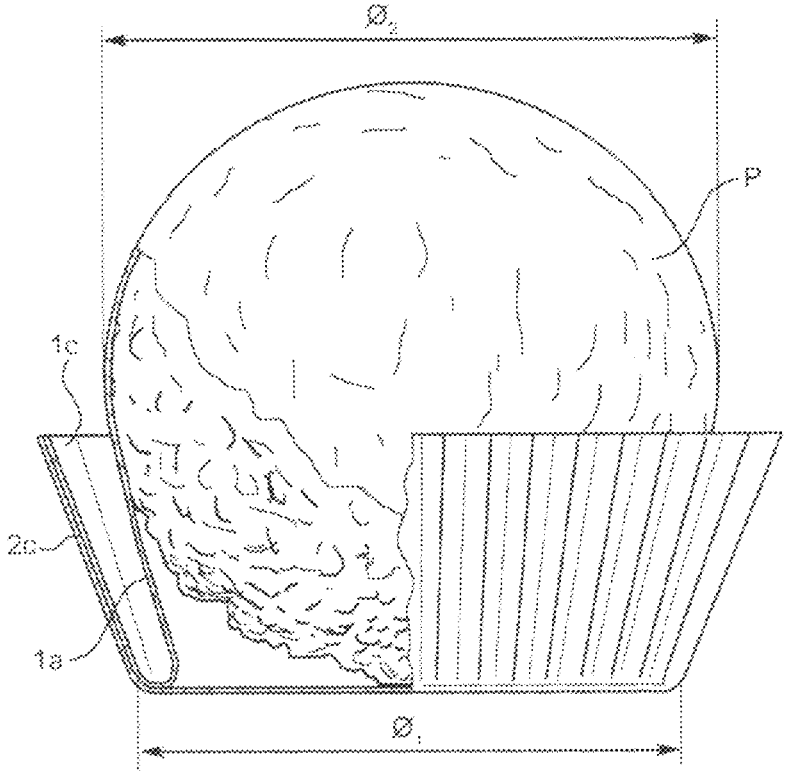

The invention will now be described, purely by way of non-limiting example, with reference to the appended drawings, in which:

FIGS. 1 to 4 diagrammatically show, in sequence, the initial stages of the method by which the intermediate packaging is obtained, according to the teaching of EP-A-1 046 579, which packaging is adapted to be subject to the final shaping stages according to the characterizing features of the present invention;

FIGS. 5, 6 and 7 diagrammatically show, in succession, the operational stages of shaping of the intermediate packaging according to the characterizing features of the present invention;

FIG. 8 is a sectional view of an elementary member, given purely by way of non-limiting example, for the application of the method of the invention; and FIG. 9 is a sectional view of a packaged product produced by the method of the invention.

In essence, the stages shown in FIGS. 1 to 4 do not differ substantially from the stages shown in the corresponding FIGS. 1 to 4 of EP-A-1 046 579. However, the method of the invention should not be considered to be limited to the reproduction of these operating stages, as it may be applied to pre-shaped packagings having features similar to those shown in FIG. 4, however they are obtained.

In the embodiment described, the product to be packaged, shown by P, is formed by a praline of overall spherical shape, the outer surface of which may—as shown—have an overall irregular appearance, due to the presence of an outer coating formed, for instance, by chopped nuts, grated coconut or granules of meringue. The invention may nevertheless be applied to products of different shape, for instance products of ovoid or elliptical shape, as well as products of frustoconical or frustopyramidal shape, adapted to be packaged with their smaller side facing the base of the pleated cup or to products with a frustoconical or frustopyramidal body provided with a dome on the side opposite their smaller side which may be spherical, ovoid, elliptical or of mixed geometric shape.

In order to form a leak-tight wrapper about the product P, two sheets 1 and 2 of aluminium or other laminar material are used. The choice of other laminar materials includes for instance the use of pairings of aluminium with composite films of plastics barrier material with thermofusible films or sheets of aluminium covered with a lacquer, preferably of a thermofusible type.

The first sheet, shown by 1, generally has dimensions which are much larger than those of the sheet 2.

The first step of the operation to package the product P comprises an operation to shape (possibly by drawing) the sheet 1 into a general cup shape with a container wall comprising a dome region 1*b*, a collar region 1*a* and a radial flange 1*c* defined by the peripheral region of the sheet 1. This operation may be carried out by means of a tool comprising a mould 3, which has a cavity 3*a* within it, into which a punch 4 having a surface 4 complementary with the inner surface of the cavity 3*a* may penetrate.

In general, the cavity 3*a* has a depth such that, once it is shaped as a cup, the sheet 1 is able internally to receive the product P more or less integrally; this solution should not, however, be considered imperative as it is also possible to envisage the case in which the product may project slightly above the opening mouth of the cup-shaped sheet 1.

Figure 1:
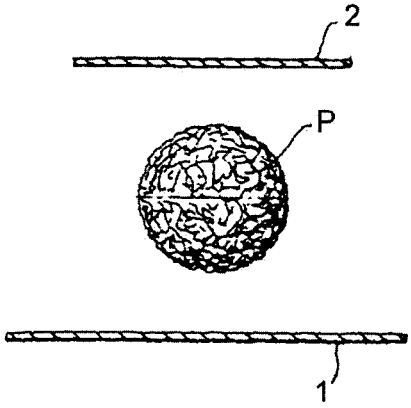
Fig.1 (PRIOR ART)
Figure 2:
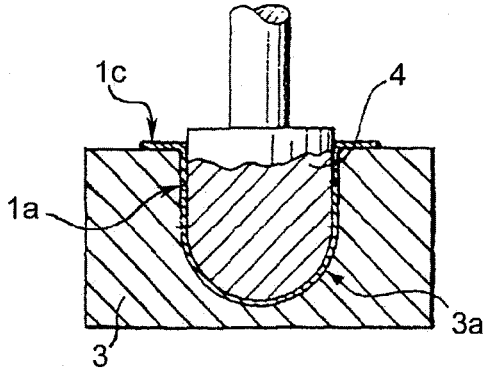
Fig.2 (PRIOR ART)
Figure 3:
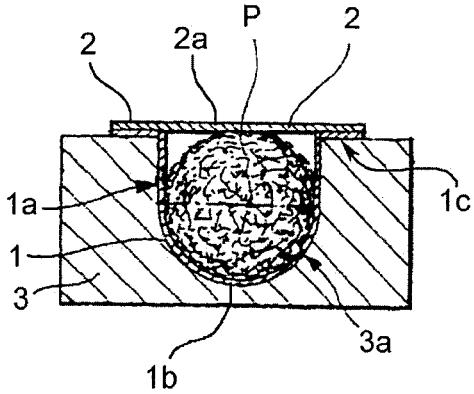
Fig.3 (PRIOR ART)

In the operating stage of FIG. 3, the product P has been positioned within the cup-shaped sheet 1 and the sheet 2 with its central region 2*a* covering the mouth of the cup and its peripheral region 2*c* superimposed on the peripheral flange region 1*c* of the sheet 1.

In the arrangement shown, in which the sheet 1 has been shaped so that it is able internally to receive substantially all of the product P, the sheet 2 is simply placed on the upper portion of the product P thus keeping its original planar shape, both in its central region 2*a* and in its peripheral region 2*c*, However, in the case in which the product projects slightly outwards from the mouth portion of the cavity 3*a*, the central region 2*a* of the sheet 2, positioned above the product, may assume, as a result of its flexibility, a curved configuration; it is also possible to envisage the case in which the central region 2*a* of the sheet 2 is pre-shaped with a cup configuration adapted to receive the projecting portion of the product P.

Figure 4:
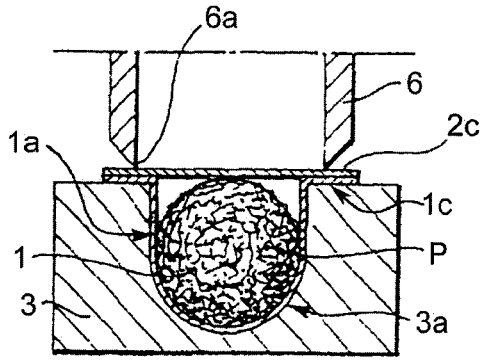
Fig.4 (PRIOR ART)

In the operating stage of FIG. 4, a tool 6 is used to seal (and possibly also cut) the sheets 1 and 2 at their respective counterpart peripheral regions 1*c* and 2*c*.

The sealing of the two sheets is adapted to ensure that the sheet wrapper provided about the product P is leak-tight. However, although it is preferable to connect the two sheets, it is not imperative for them to be sealed in a leak-tight manner.

To provide this seal, it is possible for instance to use adhesion—with added material—or heat sealing carried out preferably by promoting the fusion (by direct heat provision or the application of ultrasonic vibrational fields) of a thermofusible coating (lacquer) or a thermosetting material provided on the inner surfaces of the sheets 1 and 2.

The operation to cut the peripheral regions 1*c* and 2*c* which may be sealed together may be carried out by a punching tool, whose cutting edge, shown by 6*a* in FIG. 4, extends along a trajectory (which is circular in the embodiment shown) following the outer edge of the mouth wall of the cavity 3*a*.

FIGS. 5 to 7 show the operating stages for shaping of the pleated cup "integral" with the wrapper. This operation is carried out by means of a shaping device 10 comprising a moulding (or forming) cavity 11 and a male member 14 in the form of a punch.

The cavity 11 has a general tapered shape between an insertion opening or mouth 12 and a discharge opening or mouth 13 whose dimensions are smaller overall than the dimension of the insertion mouth 12.

Normally, the above-mentioned openings and the tapered wall of the moulding cavity 11, which extends to their junction, have a general ribbed profile so as to provide cross-sections which are, so to speak, stellate or pleated and characteristic of pleated cups. The profile of the wall connecting the insertion opening 12 and the discharge opening 13 may be rectilinear (frustoconical or frustopyramidal cavity) but may also be curved.

This means that the sectional profile of the moulding cavity 11 is adapted to the features of the product P and should not therefore be considered to be limited to a circular cross-section, as shown in the drawings.

Similarly, the wall 18 connecting the insertion opening 12 and the discharge opening 13 is preferably grooved so as to provide a pleated cup with a pleated lateral wall, but may also be smooth and may have smooth surface portions and grooved portions in a predetermined arrangement.

Preferably, the forming cavity 11 comprises a radial shoulder 15 adapted to bear the peripheral portions 1*c* and 2*c* of the wrapper sheets.

According to an innovative feature of the method and the device of the invention, the male member 14 comprises a petal mandrel whose petals may move radially between an extended position and a retracted position.

In the diagrammatic cross-sections of FIGS. 5 to 7, two petals 14*a* and 14*b* are shown, but it will be appreciated that the mandrel could be formed by a plurality of petals (for instance from three to six petals), typically four, depending on the dimensional features of the product P.

In the case of four petals, each petal extends radially over an angular amplitude of approximately 90°. Each petal has a tapered end portion 16 converging towards the axis a-a of the mandrel in the direction of the arrow $F_3$ (FIG. 6), which—in the retracted configuration of the mandrel—is able to penetrate into the forming cavity 11 and has a tapered radially outer surface 17 substantially complementary with a counterpart portion of the wall 18 of the forming cavity 11.

The outer surface 19 of the end portion 16 is also tapered and converges towards the axis a-a of the mandrel in the direction of the arrow $F_3$.

The outer surface 17 of the end section 16 of the mandrel which, as mentioned above, is complementary with a counterpart portion of the wall 18 of the forming cavity 11 will preferably therefore be ribbed.

The petal mandrel 14 may move axially relative to the forming cavity 11 between a position spaced from this cavity, in which the petals of the mandrel are in the extended configuration, able to encompass the container wall 1*a* of the wrapper, and a forward position in which the tapered end of the mandrel has penetrated into the forming cavity 11 and the petals 14*a*, 14*b* are in the retracted position. The relative movement of the mandrel 14 with respect to the forming cavity 11 takes place under the action of motor means (for instance linear actuators) which are not shown in FIGS. 5 to 7 as they are known per se.

It will be appreciated that the reference to a relative movement includes the case in which the mandrel may move with respect to the fixed forming cavity, and the opposite case in which the forming cavity may move with respect to a fixed mandrel, as well as the case in which both may move with respect to one another.

The motor means may therefore be associated with either the mandrel or the forming cavity.

FIG. 5 shows an initial position, in which the mandrel 14 is spaced from the forming cavity, with the petals in the extended position, and the intermediate packaging in which the product P is wrapped by the two sheets according to the configuration shown in FIG. 4, is positioned above the forming cavity 11. In this position, a support member 20, comprising a rod 21 and a plate 22, supports and bears the central region of the wrapper 2*a*.

The rod 21 may move axially and is adapted to be gradually retracted from the inside of the forming cavity in a coordinated manner with the penetration action of the mandrel 14, supporting, during this movement, the base of the wrapped product P. For that purpose, the rod 21 may be configured in the form of a take-up member, for instance by vacuum, as it has a longitudinal internal duct 23 which communicates at the location of the plate 22 and is connected on the opposite side to a sub-atmospheric pressure source so as to ensure that the wrapped product P received is held on the plate 22 and follows this plate during the movement of penetration into and/or extraction from the forming cavity 11.

Optionally, the shaping device 10 further comprises a support and/or thrust member 24 which may move in a linear manner with respect to the forming cavity 11 and has a seat 25 complementary with the end crown portion 1*b* of the wrapper. The linear movement of the support and/or thrust member 24 is coordinated with the linear movement of the rod 21 in order to cause the wrapped product P to penetrate into the forming cavity 11.

FIG. 6 shows the position in which the thrust member 24 engages the crown 1*b* of the wrapped product P and in which the petals 14*a*, 14*b* are in the extended position, encompassing the greater dimension of the wrapped product.

FIG. 7 shows an intermediate position, in which the wrapped product P has partially penetrated into the forming cavity 11 and the petals 14*a*, 14*b* have been progressively actuated in the direction and way of the arrows $F_1$ and $F_2$ towards their end retracted position by means of actuator means (not shown).

After the petal mandrel 14 has penetrated into the forming cavity 11, the peripheral regions 1*c* and 2*c* of the intermediate packaging are shaped into the desired pleated cup configuration, shown in FIG. 9, which configuration is stable as a result of the general plastic behaviour of the sheets 1 and 2.

In a preferred embodiment, the forming cavity 11 may be heated and then possibly cooled as heating and possible subsequent cooling improve the stability of the pleating. For that purpose, a short dwell time in the end forming position may be provided, which dwell time may be selected as a function of the properties of the sheet material used.

The packaging may be discharged from the forming cavity 11 either via the smaller opening 13 (previously defined as the discharge opening) as a result of the drawing action that the plate 22—(by means of the suction duct 23)—exerts on the wrapper, or through the opening 12 (previously defined as the insertion opening). In this latter case, it will be appreciated that the removal of the packaged product takes place after the mandrel 14 has been returned to the position spaced from the forming cavity 11.

With reference to the final packaging shown in FIG. 9, it will be noted that as a result of the actuation of the petal mandrel, in the retracted position, the wall 1*a* of the sheet 1 is closed up to the outer surface of the product as a result of which the adhesion of the wrapper and in particular of the sheet 1 to the outer surface of the product P is improved. It will also be noted that the transverse base dimension of the pleated cup (diameter) shown by $\Phi_1$ in FIG. 9, is smaller than the maximum transverse dimension $\Phi_2$ of the wrapped product P.

By appropriate shaping of the end portion 16 of the petals 14, it is also possible further to improve the adhesion of the wall 1*a* to the wall of the wrapper with respect to what is shown purely by way of example in FIG. 9.

FIG. 8 is a sectional view showing a detail of a device for the implementation of the packaging method described above.

In FIG. 9, those members corresponding to the members shown in FIGS. 1 to 7 bear the same reference numerals.

It will in particular be noted in the example of FIG. 8, given purely by way of example, in order to describe a basic actuation system for a mandrel, that the petal mandrel 14, and the member 24, may move upwards in the direction of the forming cavity 11. The member 24 acts as a support and thrust member and is adapted to cause the intermediate packaging to penetrate into the forming cavity 11.

Each petal 14*a*, 14*b* (at least four petals are also to be preferred in this case) is connected to at least one cursor 25, 26 sliding in a respective slot 27, 28 which—in the direction of forward movement of the mandrel 14 towards the forming cavity 11—comprises a section 27*a*, 28*a* converging towards the longitudinal axis of the mandrel 14. In this way, the forward movement of the mandrel towards the forming cavity by means of motor means (not shown) causes the actuation of the petals into their retracted position.

The slots 27 and 28 thus have a rectilinear terminal section in which the respective cursor 25, 26 may move in order to cause the removal of the shaped product P upwards through the discharge opening 13 of the forming cavity 11.

As mentioned above, the lateral wall 1*c*, 2*c* of the pleated cup, integral with the packaging, is preferably a pleated wall. In order to obtain the best results and optimize the shape of the pleated cup, the pleating pitch of the wall of the forming cavity 11 and the complementary outer surface of the petal members (i.e. the distance between two successive ridges) is calculated as a function of the base diameter $\Phi_1$ of the pleated cup and the conical nature of the forming cavity 11 so as to ensure that the pleated wall is free from superimpositions and wrinkles and is radiated and well extended.

It will be appreciated that the choice of these parameters in order to achieve the best result is among the skills of a person skilled in the art.

As indicated in EP 1 046 579, whose specification is considered to be incorporated into the present specification as a result of its citation, the method of the invention may be applied either with sheets 1 and 2 formed by the same material and/or having identical chromatic features, or with sheets formed by different materials and/or having different chromatic features.

Naturally, the principle of the invention remaining the same, the forms of embodiment and details of construction may be varied widely with respect to those described and illustrated, without thereby departing from the scope of the appended claims.

The invention claimed is:

1. A method for packaging a product in a shaped wrapper of sheet material, comprising the operations of:

obtaining an intermediate packaging, including a first sheet having a cup-shaped configuration, with a container wall including the product and a mouth surrounded by a radial flange formed by a peripheral region of said sheet, and a second sheet having a central region disposed to cover the mouth and a peripheral region disposed in a superimposed relationship with respect to the peripheral region of the first sheet forming the flange, and shaping said peripheral regions of the intermediate packaging in order to form a wrapper portion shaped as a cup which surrounds the container wall of the first shaped sheet at a radial distance, by means of shaping means which comprise a forming cavity able internally to receive the intermediate packaging and a male member, in the form of a punch, able to penetrate into the forming cavity in order to force the peripheral regions of the first and second sheets between the inner surface of the forming cavity and the outer surface of said male member, characterized in that the male member in the form of a punch comprises a petal mandrel whose petals may move between a radially extended position in which the petals are able to encompass the container wall of the intermediate packaging and a retracted position in which the petals are able to penetrate into the forming cavity so as to form the cup formed by the radial flanges adhering to the product.

2. The method of claim 1, wherein the petals have a tapered end portion converging towards the axis of the mandrel in the direction of penetration of the mandrel into the forming cavity.

3. The method of claim 2, wherein the tapered end portion comprises a radially inner surface tapered in a direction converging towards the axis of the mandrel.

4. The method of claim 1, wherein the intermediate packaging is obtained by a method comprising the stages of:

providing a first and a second sheet of wrapping material, shaping the first sheet into a cup-shaped configuration able internally to receive the product, inserting the product into the first sheet shaped in this way, applying the second sheet to the opening mouth of the first cup-shaped sheet, and connecting the counterpart peripheral regions of the first and the second sheets in order to form a wrapper substantially closed about the product.

5. The method of claim 1, wherein the first and the second sheets are sealed together by a sealing operation selected from the group including:

gluing with the application of added material, heat sealing, and ultrasonic sealing.

6. The method of claim 1, comprising the operation of coating the first and the second sheets with a layer of thermofusible material at the location of the surfaces to be connected.

7. The method of claim 1, wherein the operation to shape the peripheral regions of the intermediate packaging is carried out by subjecting the sheet material to heating and possibly then to cooling, in the forming cavity, in order to maintain the shape of the cup and the relative pleats faithful to the shape of the forming cavity.

8. The method of claim 1, wherein the peripheral regions of the first and second sheets are shaped as a cup with a pleated wall.

9. A device for packaging a product in a shaped wrapper of sheet material from an intermediate packaging comprising a first sheet having a general cup-shaped configuration with a container wall in which the product is housed and a mouth surrounded by a flange formed by a peripheral region of the first sheet, and a second sheet having a central region disposed to cover said mouth and a peripheral region disposed in a superimposed relationship with respect to the counterpart peripheral region of the first sheet, wherein the device comprises a shaping means comprising:

a forming cavity having a forming wall adapted internally to receive the intermediate packaging, a male member, in the form of a punch, having a forming surface complementary with the forming wall of said forming cavity, said male member being movable relative to the forming cavity in order to penetrate into said forming cavity, so as to force the counterpart peripheral regions of the first and second sheets between the inner surface of the forming cavity and the outer surface of the male member in order to shape said peripheral regions of said first and second sheet into a cup configuration surrounding the container wall of the first sheet at a radial distance, wherein said male member comprises a mandrel with petals, said petals being movable between a radially extended position able to encompass the container wall of the first sheet and a retracted position in which the petals are able to penetrate into the forming cavity.

10. The device of claim 9, wherein the shaping means comprises an actuator means adapted to cause the actuation of the petals between the extended position and the retracted position during the stroke of the movement of penetration of the petal mandrel into the forming cavity.

11. The device of claim 9, wherein each of the petals has a tapered end portion converging towards the axis of the mandrel, comprising a radially inner surface tapered in the direction of penetration of the male member into the forming cavity.

12. The device of claim 9, wherein the forming cavity and the petals have tapered developments which are complementary with one another, tapering taking place in the direction of penetration of the male member into the forming cavity.

13. The device of claim 9, wherein the shaping means comprise a support and/or thrust member moving relative to the forming cavity and having an end seat adapted to engage an end head portion of the intermediate packaging.

14. The device of claim 9, further comprising a rod support member adapted to support the central region of the intermediate packaging.

15. The device of claim 9, wherein the mandrel with petals may move axially relative to the forming cavity between a position spaced from said cavity, in which the petals of the mandrel are in an extended configuration able to encompass the container wall of the wrapper and an end position in which the end of the petals has penetrated into the forming cavity and the petals are in a retracted position and further comprising actuator means adapted to cause the petals to move from the extended position to the retracted position during the movement of penetration of the petals into the forming cavity.

16. The device of claim 15, wherein the actuator means comprise, for each of the petals, a cursor member moving in a slot comprising a sliding section converging towards the axis of the mandrel in the direction of penetration of the mandrel into the forming cavity.

* * * * *